US012281812B2

(12) United States Patent
Aoshima

(10) Patent No.: US 12,281,812 B2
(45) Date of Patent: Apr. 22, 2025

(54) DUCT CONTROL APPARATUS

(71) Applicant: Mitsubishi Electric Corporation, Tokyo (JP)

(72) Inventor: Takuma Aoshima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 216 days.

(21) Appl. No.: 17/800,934

(22) PCT Filed: Mar. 4, 2020

(86) PCT No.: PCT/JP2020/009221
§ 371 (c)(1),
(2) Date: Aug. 19, 2022

(87) PCT Pub. No.: WO2021/176607
PCT Pub. Date: Sep. 10, 2021

(65) Prior Publication Data

US 2023/0084996 A1 Mar. 16, 2023

(51) Int. Cl.
*F24F 11/74* (2018.01)
*F24F 13/14* (2006.01)

(52) U.S. Cl.
CPC ..... *F24F 11/74* (2018.01); *F24F 13/14* (2013.01)

(58) Field of Classification Search
CPC ..... F24F 13/14; F24F 11/74
USPC ..... 236/49.3
See application file for complete search history.

(56) References Cited

U.S. PATENT DOCUMENTS 10,270,357 B2 4/2019 Aoshima

FOREIGN PATENT DOCUMENTS

| | | | |
|---|---|---|---|
| JP | 3-139359 | A | 6/1991 |
| JP | 2003-214688 | A | 7/2003 |
| JP | 2004-286383 | A | 10/2004 |
| JP | 2012-017867 | A | 1/2012 |
| JP | 2019-22253 | A | 2/2019 |
| WO | 2016/103326 | A1 | 6/2016 |

OTHER PUBLICATIONS

International Search Report of the International Searching Authority mailed May 26, 2020 in International Patent Application No. PCT/JP2020/009221 (with English translation).
Office Action dated Aug. 17, 2023 issued in corresponding United Kingdom Patent Application No. 2212375.6.

*Primary Examiner* — Nael N Babaa
(74) *Attorney, Agent, or Firm* — Posz Law Group, PLC

(57) ABSTRACT

A first duct control apparatus is an apparatus that controls a motor that controls opening and closing of a duct opening and closing device provided in a duct for sending air from an air conditioner to a room, and includes: a power supply board that receives commercial power; a motor board that controls the motor based on the commercial power received by the power supply board; and a control board that controls the motor board based on the commercial power received by the power supply board. The motor board performs, for the motor, control of the opening and closing of the duct opening and closing device and control for adjusting a degree of opening of the duct opening and closing device. The power supply board, the motor board, and the control board are provided in a single unit.

6 Claims, 7 Drawing Sheets

DUCT CONTROL APPARATUS

CROSS-REFERENCE TO RELATED APPLICATION

This application is a U.S. National Stage Application of International Application No. PCT/JP2020/009221 filed on Mar. 4, 2020, the contents of which are incorporated herein by reference.

FIELD

The present disclosure relates to a duct control apparatus that controls the opening and closing of a duct opening and closing device provided in a duct for sending air from an air conditioner to a room.

BACKGROUND

Conventionally, there is known an air conditioner embedded in a ceiling. The air conditioner is connected to a duct for sending air from the air conditioner to a room, and the duct is provided with a duct opening and closing device. A duct control apparatus for controlling the opening and closing of a duct opening and closing device has been proposed (see, for example, Patent Literature 1).

PATENT LITERATURE

Patent Literature 1: WO 2016/103326 A

A conventional duct control apparatus controls the opening and closing of a duct opening and closing device, but does not perform control for adjusting the degree of opening of the duct opening and closing device. There is a demand for a duct control apparatus that performs control for adjusting the degree of opening of a duct opening and closing device.

SUMMARY

The present disclosure has been made in view of the above, and an object of the present disclosure is to obtain a duct control apparatus that performs control for adjusting the degree of opening of a duct opening and closing device.

In order to solve the above-described problem and achieve the object, a duct control apparatus according to the present disclosure controls a motor that controls opening and closing of a duct opening and closing device provided in a duct for sending air from an air conditioner to a room. The duct control apparatus includes: a power supply board that receives commercial power; a motor board that controls the motor based on the commercial power received by the power supply board; and a control board that controls the motor board based on the commercial power received by the power supply board. The motor board performs, for the motor, control of the opening and closing of the duct opening and closing device and control for adjusting a degree of opening of the duct opening and closing device. The power supply board, the motor board, and the control board are provided in a single unit. The motor board has a function of controlling a plurality of motors. When it is not possible to cause a plurality of duct opening and closing devices to simultaneously operate, the plurality of duct opening and closing devices opening and closing a plurality of ducts, the motor board performs control for causing only a closed duct opening and closing device to operate among the plurality of duct opening and closing devices, the control being performed for a motor corresponding to the closed duct opening and closing device among the plurality of motors.

The duct control apparatus according to the present disclosure has the effect of enabling control for adjusting the degree of opening of the duct opening and closing device.

DETAILED DESCRIPTION

Hereinafter, a duct control apparatus according to an embodiment will be described in detail with reference to the drawings.

EMBODIMENT

Figure 1:
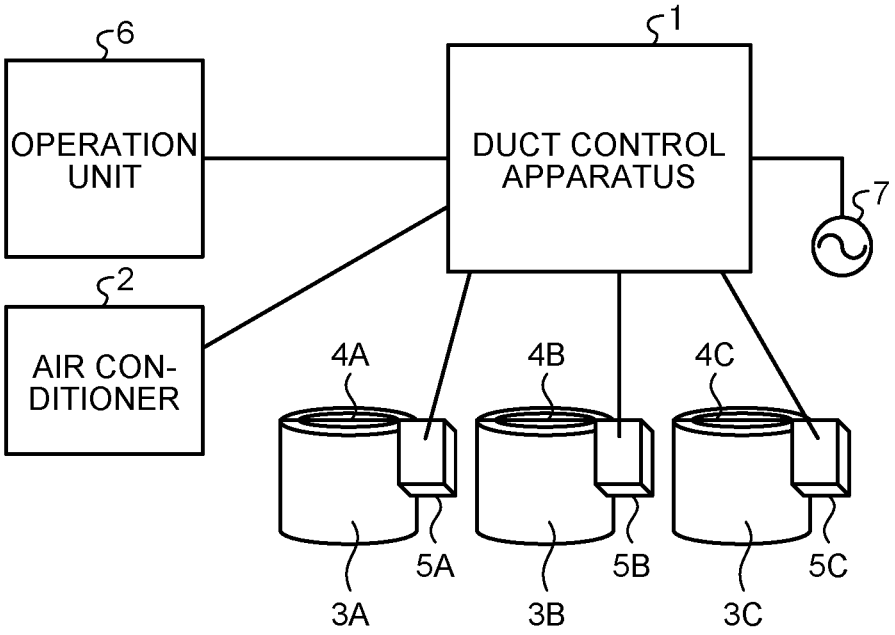
FIG. 1 is a diagram for describing an outline of a duct control apparatus according to an embodiment.

FIG. 1 is a diagram for describing an outline of a duct control apparatus 1 according to an embodiment. The duct control apparatus 1 is an apparatus that controls a motor that controls the opening and closing of a duct opening and closing device provided in a duct for sending air from an air conditioner 2 to a room. FIG. 1 also illustrates the air conditioner 2. The duct control apparatus 1 is connected to the air conditioner 2.

FIG. 1 also illustrates a first duct opening and closing unit 3A, a second duct opening and closing unit 3B, and a third duct opening and closing unit 3C. The first duct opening and closing unit 3A is provided in a first duct. The second duct opening and closing unit 3B is provided in a second duct. The third duct opening and closing unit 3C is provided in a third duct. The first duct, the second duct, and the third duct are not illustrated in FIG. 1.

A first duct opening and closing device 4A is installed in the first duct opening and closing unit 3A. In addition, a first motor 5A is attached to the first duct opening and closing unit 3A. FIG. 1 also illustrates the first duct opening and closing device 4A and the first motor 5A. The first duct opening and closing device 4A is opened and closed by the first motor 5A being driven. The first motor 5A controls the opening and closing of the first duct opening and closing device 4A, and thus controls an airflow to be supplied from the air conditioner 2 to the room via the first duct.

A second duct opening and closing device 4B is installed in the second duct opening and closing unit 3B. In addition, a second motor 5B is attached to the second duct opening and closing unit 3B. FIG. 1 also illustrates the second duct opening and closing device 4B and the second motor 5B. The second duct opening and closing device 4B is opened and closed by the second motor 5B being driven. The second motor 5B controls the opening and closing of the second duct opening and closing device 4B, and thus controls an airflow to be supplied from the air conditioner 2 to the room via the second duct.

A third duct opening and closing device 4C is installed in the third duct opening and closing unit 3C. In addition, a third motor 5C is attached to the third duct opening and closing unit 3C. FIG. 1 also illustrates the third duct opening and closing device 4C and the third motor 5C. The third duct opening and closing device 4C is opened and closed by the third motor 5C being driven. The third motor 5C controls the opening and closing of the third duct opening and closing device 4C, and thus controls an airflow to be supplied from the air conditioner 2 to the room via the third duct.

For each of the first duct opening and closing device 4A, the second duct opening and closing device 4B, and the third duct opening and closing device 4C, the opening in the phrase "opening and closing" refers to causing air to flow through the duct, and the closing in the phrase "opening and closing" refers to closing the duct so as not to cause air to flow through the duct. In some cases, each of the first duct opening and closing device 4A, the second duct opening and closing device 4B, and the third duct opening and closing device 4C is controlled such that each of the first duct opening and closing device 4A, the second duct opening and closing device 4B, and the third duct opening and closing device 4C is in a state between a fully closed state and a fully opened state. That is, the degree of opening of each of the first duct opening and closing device 4A, the second duct opening and closing device 4B, and the third duct opening and closing device 4C can be adjusted. For example, the degree of opening of each of the first duct opening and closing device 4A, the second duct opening and closing device 4B, and the third duct opening and closing device 4C is adjusted to 10% or 50%. The amount of air flowing through the duct is adjusted by adjustment of the degree of opening.

The duct control apparatus 1 is also connected to an operation unit 6 to be operated by a user. FIG. 1 also illustrates the operation unit 6. The duct control apparatus 1 receives, from the operation unit 6, an instruction corresponding to an operation performed on the operation unit 6 by the user, and controls the first motor 5A, the second motor 5B, and the third motor 5C according to the received instruction, based on commercial power supplied from a commercial power supply unit 7. That is, the duct control apparatus 1 controls the first motor 5A, the second motor 5B, and the third motor 5C according to the user's operation. As a result, the duct control apparatus 1 controls the opening and closing of each of the first duct opening and closing device 4A, the second duct opening and closing device 4B, and the third duct opening and closing device 4C, and adjusts the respective degrees of opening. FIG. 1 also illustrates the commercial power supply unit 7. For example, the voltage of the commercial power is set to any value between 200 V and 240 V.

As described above, the duct control apparatus 1 controls the first motor 5A, the second motor 5B, and the third motor 5C according to the user's operation, so that the duct control apparatus 1 controls the opening and closing of each of the first duct opening and closing device 4A, the second duct opening and closing device 4B, and the third duct opening and closing device 4C, and adjusts the respective degrees of opening. That is, the user can adjust the amount of air flowing through each duct by controlling the opening and closing of each of the first duct opening and closing device 4A, the second duct opening and closing device 4B, and the third duct opening and closing device 4C and adjusting the respective degrees of opening.

Note that the duct control apparatus 1 need not be connected to the operation unit 6 by wire. The duct control apparatus 1 may be wirelessly connected to the operation unit 6. In short, the duct control apparatus 1 just needs to be capable of receiving an instruction from the operation unit 6.

Figure 2:
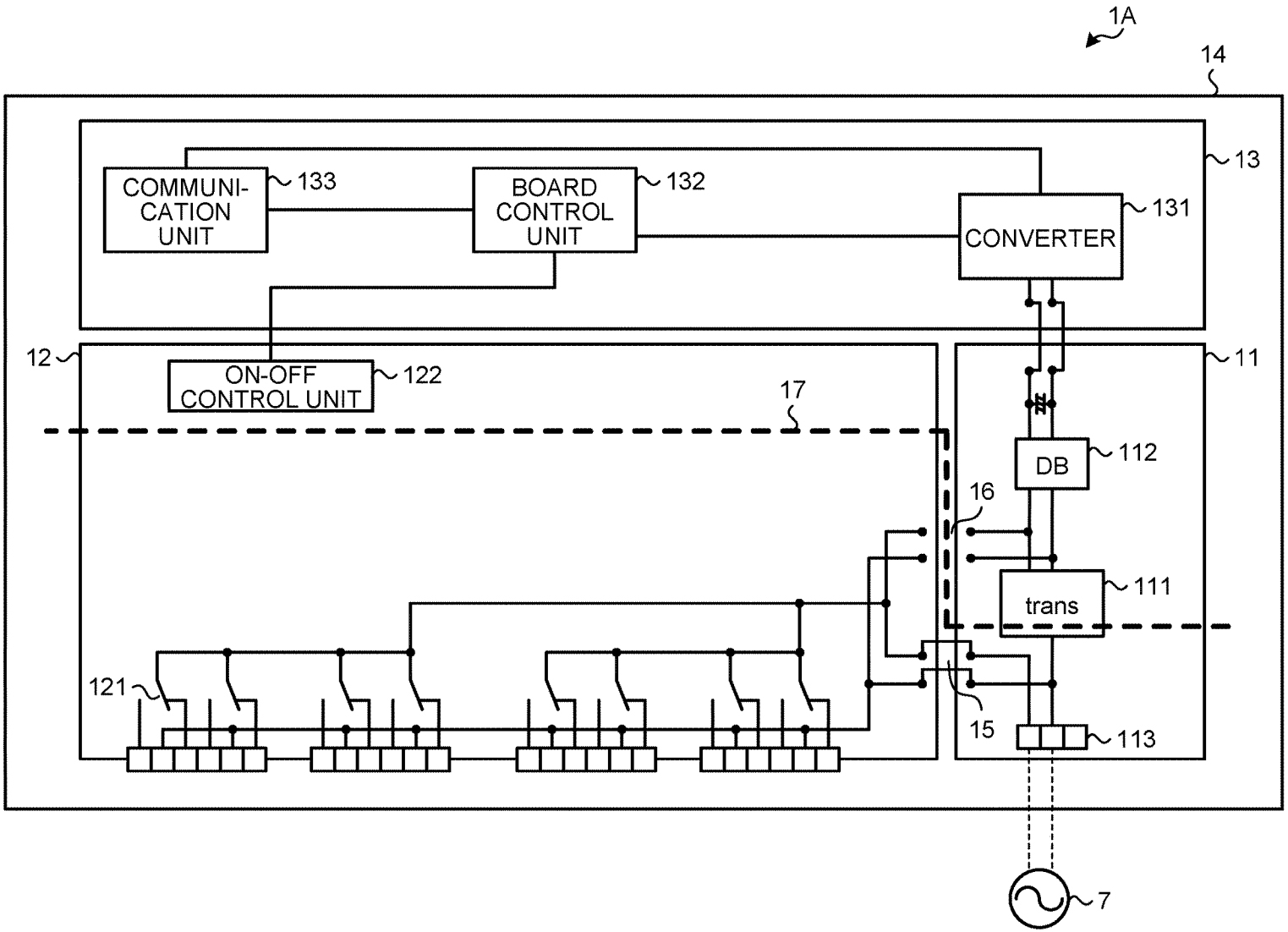
FIG. 2 is a diagram illustrating a configuration of a first duct control apparatus according to the embodiment.

FIG. 2 is a diagram illustrating a configuration of a first duct control apparatus 1A according to the embodiment. The first duct control apparatus 1A is an example of the duct control apparatus 1. The first duct control apparatus 1A includes a power supply board 11 and a motor board 12. The power supply board 11 receives commercial power supplied from the commercial power supply unit 7. The motor board 12 controls a motor based on the commercial power received by the power supply board 11. The motor is representative of the first motor 5A, the second motor 5B, and the third motor 5C. The motor is not illustrated in FIG. 1. The motor board 12 performs, for the motor, control of the opening and closing of a duct opening and closing device and control for adjusting the degree of opening of the duct opening and closing device. The duct opening and closing device is representative of the first duct opening and closing device 4A, the second duct opening and closing device 4B, and the third duct opening and closing device 4C. The duct opening and closing device is not illustrated in FIG. 1.

The first duct control apparatus 1A further includes a control board 13 that controls the motor board 12 based on the commercial power received by the power supply board 11. The power supply board 11, the motor board 12, and the control board 13 are provided in a single unit 14. For example, the unit 14 is a housing. When the unit 14 is a housing, the power supply board 11, the motor board 12, and the control board 13 are disposed inside the unit 14. The unit 14 may be a board. When the unit 14 is a board, the power supply board 11, the motor board 12, and the control board 13 are attached to the unit 14.

The power supply board 11 has the function of lowering the voltage of the commercial power. Specifically, the power supply board 11 includes a transformer 111 that lowers the voltage of the commercial power. For example, the transformer 111 reduces the voltage of the commercial power to one tenth of the voltage of the commercial power. The area of the transformer 111 is smaller than the area of the power supply board 11. The transformer 111 is disposed on the power supply board 11. The transformer 111 of the first duct control apparatus 1A is a reinforced-insulation transformer that is a transformer having a relatively low insulation degree. The motor board 12 controls the motor based on one of the voltage of the commercial power and a voltage obtained by the power supply board 11 lowering the voltage of the commercial power.

The first duct control apparatus 1A further includes a first connecting portion 15 that connects the power supply board 11 and the motor board 12, and supplies the commercial power from the power supply board 11 to the motor board 12. The first duct control apparatus 1A further includes a second connecting portion 16 that connects the power supply board 11 and the motor board 12, and supplies low-voltage power from the power supply board 11 to the motor board 12. The low-voltage power is power to be obtained by the power supply board 11 lowering the voltage of the commercial power. The motor board 12 controls the motor based on one of the commercial power and the low-voltage power. The commercial power is supplied from the power supply board 11 via the first connecting portion 15. The low-voltage power is supplied from the power supply board 11 via the second connecting portion 16. Note that when the first duct control apparatus 1A controls the motor based on the commercial power, the first duct control apparatus 1A need not include the second connecting portion 16. FIG. 2 illustrate a state where the second connecting portion 16 does not connect the power supply board 11 and the motor board 12.

The power supply board 11 further includes a diode bridge 112 that converts an AC voltage obtained by the transformer 111 into a DC voltage. The power supply board 11 smooths the DC voltage obtained by the diode bridge 112, and supplies the smoothed DC voltage to the control board 13. For example, the power supply board 11 supplies a DC voltage of 30 V to the control board 13. FIG. 2 also illustrates a commercial power supply destination 113 on the power supply board 11. The term "commercial power supply destination" refers to a portion of the power supply board 11 to which the commercial power is supplied.

The control board 13 includes a converter 131, a board control unit 132, and a communication unit 133. The converter 131 converts the voltage value of a DC voltage. The board control unit 132 controls the motor board 12. The communication unit 133 communicates with the operation unit 6. Power obtained by the converter 131 is supplied to the board control unit 132 and the communication unit 133. Each of the board control unit 132 and the communication unit 133 operates based on the power obtained by the converter 131.

The motor is connected to the motor board 12. As described above, the motor is representative of the first motor 5A, the second motor 5B, and the third motor 5C. The motor controls the opening and closing of the corresponding duct opening and closing device, and adjusts the degree of opening. The motor board 12 includes a plurality of switches 121 that operates based on power supplied from the power supply board 11. Each of the plurality of switches 121 is, for example, a C contact relay. The opening and closing of the duct opening and closing device and the adjustment of the degree of opening are controlled by the opening and closing of the plurality of switches 121.

The motor board 12 further includes an on-off control unit 122 for controlling the opening and closing of the duct opening and closing device and also adjusting the degree of opening. The on-off control unit 122 controls operation of the plurality of switches 121. As described above, the opening and closing of the duct opening and closing device and the adjustment of the degree of opening are controlled by the opening and closing of the plurality of switches 121. The on-off control unit 122 is controlled by the board control unit 132 of the control board 13. That is, the operation of the plurality of switches 121 is controlled by the board control unit 132 of the control board 13. The on-off control unit 122 adjusts the degree of opening of the duct opening and closing device in accordance with time when a signal for adjusting the degree of opening of the duct opening and closing device is provided.

The first duct control apparatus 1A further includes a basic-insulation portion 17 that insulates the plurality of switches 121 from the on-off control unit 122. The first duct control apparatus 1A controls the duct opening and closing device based on a relatively high voltage. Specifically, the first duct control apparatus 1A controls the duct opening and closing device based on the commercial power. Therefore, the basic-insulation portion 17 insulates the plurality of switches 121 from the on-off control unit 122. The control side and the high-voltage side are insulated by the basic-insulation portion 17.

Figure 3:
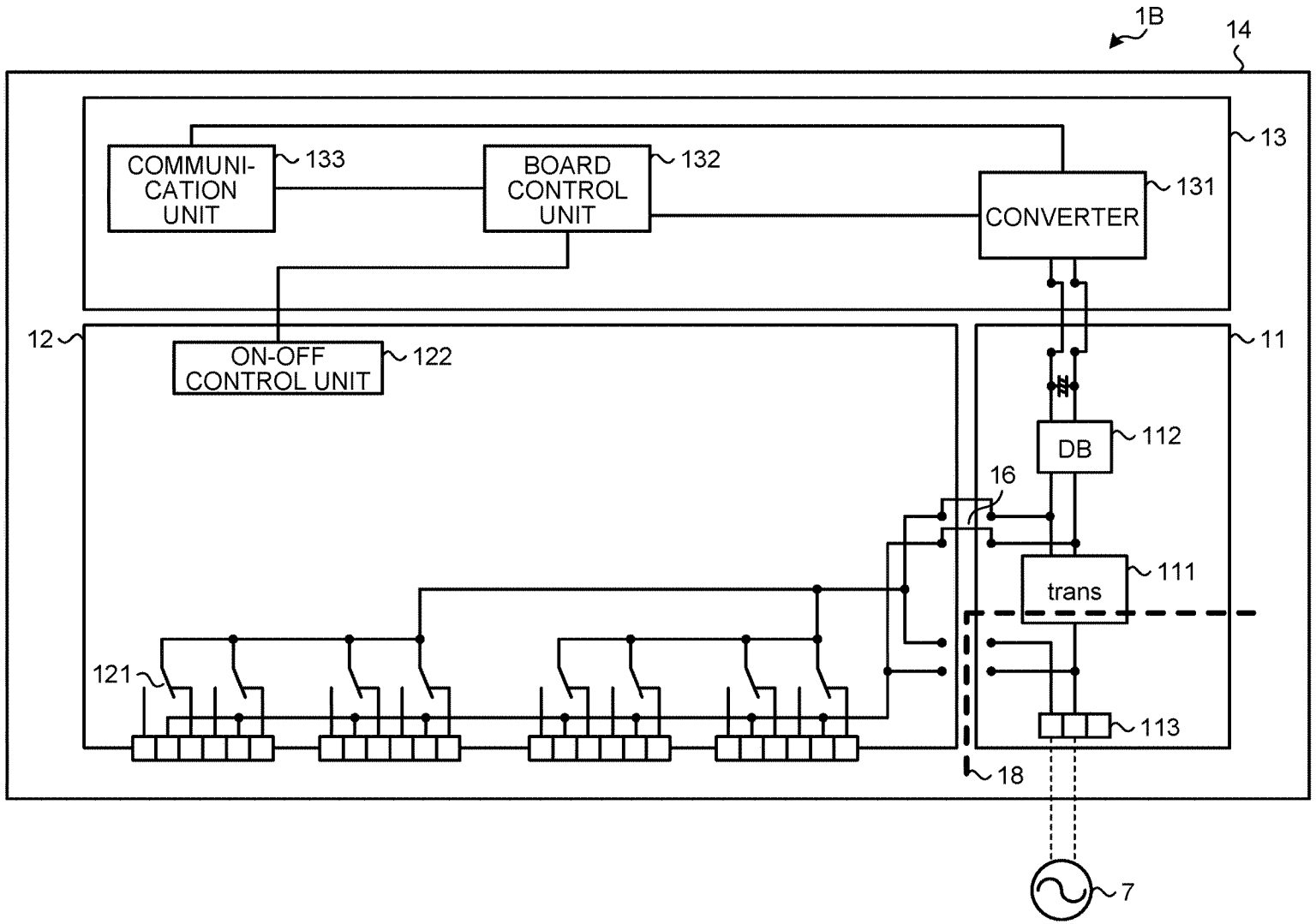
FIG. 3 is a diagram illustrating a configuration of a second duct control apparatus according to the embodiment.

FIG. 3 is a diagram illustrating a configuration of a second duct control apparatus 1B according to the embodiment. The second duct control apparatus 1B is another example of the duct control apparatus 1. The second duct control apparatus 1B is an apparatus that controls the duct opening and closing device based on a relatively low voltage. The second duct control apparatus 1B includes a plurality of constituent elements of the first duct control apparatus 1A except the first connecting portion 15 and the basic-insulation portion 17. The second duct control apparatus 1B includes a reinforced-insulation portion 18. Hereinafter, a difference between the second duct control apparatus 1B and the first duct control apparatus 1A will be mainly described. Note that the second duct control apparatus 1B may include the first connecting portion 15.

The motor board 12 is supplied with power obtained by the transformer 111 lowering the voltage of the commercial power. For example, power of 24 V is supplied from the power supply board 11 to the motor board 12 via the second connecting portion 16. The transformer 111 of the second duct control apparatus 1B is a reinforced-insulation transformer that is a transformer having a relatively high insulation degree. The transformer 111 having a relatively high insulation degree is a transformer that can be replaced with the transformer 111 having a relatively low insulation degree. Therefore, it is relatively easy to change the second duct control apparatus 1B to the first duct control apparatus 1A. Similarly, the transformer 111 having a relatively low insulation degree is a transformer that can be replaced with the transformer 111 having a relatively high insulation degree. Therefore, it is relatively easy to change the first duct control apparatus 1A to the second duct control apparatus 1B.

The power supply board 11 smooths the DC voltage obtained by the diode bridge 112, and supplies the smoothed DC voltage to the control board 13. For example, the power supply board 11 supplies a DC voltage of 24 V to the control board 13. The reinforced-insulation portion 18 insulates the plurality of switches 121 from the commercial power supply destination 113 on the power supply board 11.

As illustrated in FIGS. 2 and 3, the insulation distance between the plurality of switches 121 and the commercial power supply destination 113 on the power supply board 11, the commercial power being supplied to the commercial power supply destination 113 when the motor board 12 controls the motor based on a voltage lower than the voltage of the commercial power, is shorter than the insulation distance between the plurality of switches 121 and the commercial power supply destination 113 on the power supply board 11, the commercial power being supplied to the commercial power supply destination 113 when the motor board 12 controls the motor based on the voltage of the commercial power.

Figure 4:
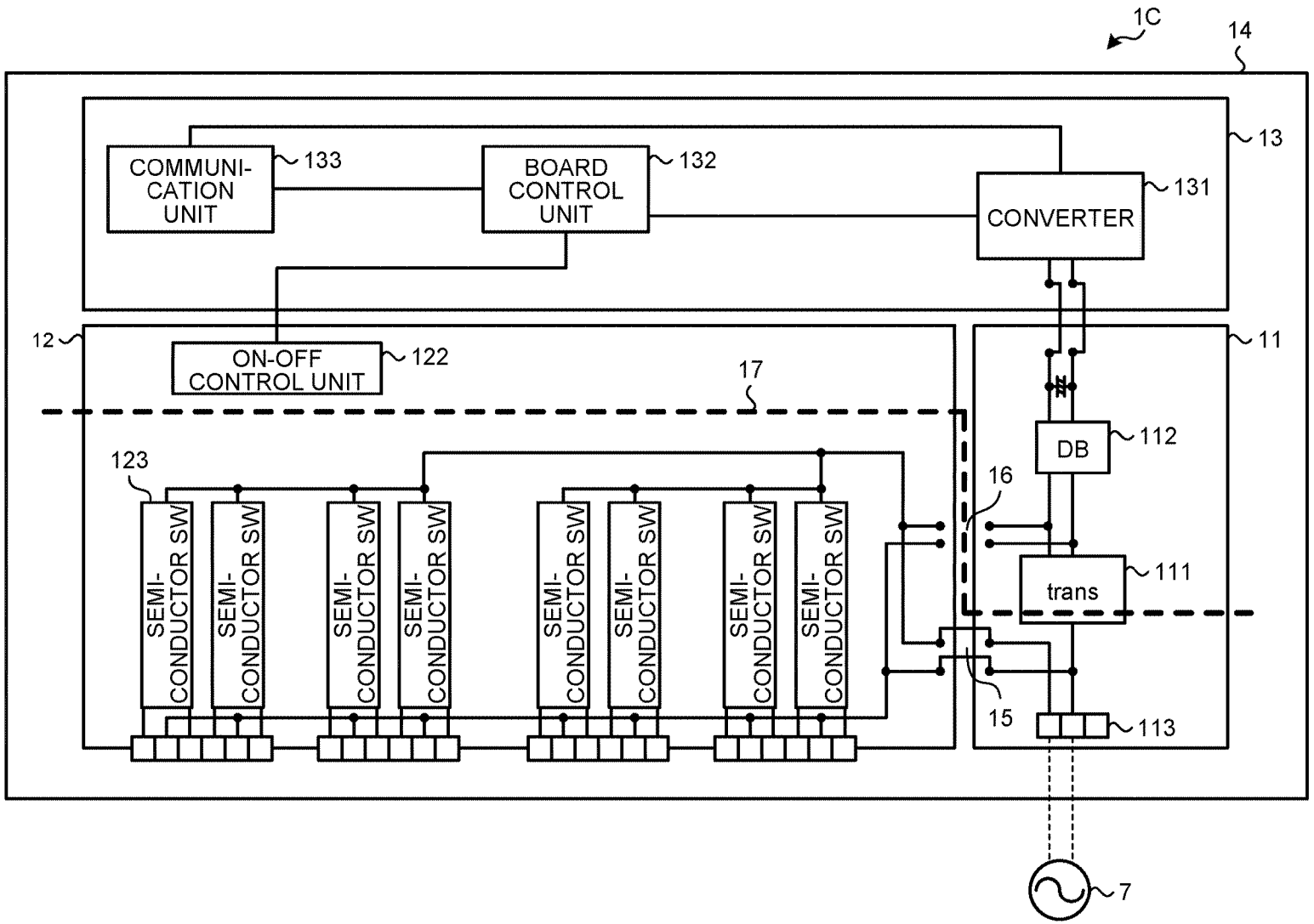
FIG. 4 is a diagram illustrating a configuration of a third duct control apparatus according to the embodiment.

FIG. 4 is a diagram illustrating a configuration of a third duct control apparatus 1C according to the embodiment. The third duct control apparatus 1C is another example of the duct control apparatus 1. The third duct control apparatus 1C is an apparatus that controls the duct opening and closing device based on a relatively high voltage. Specifically, the third duct control apparatus 1C includes the plurality of constituent elements of the first duct control apparatus 1A except the plurality of switches 121. The third duct control apparatus 1C includes a plurality of semiconductor switches 123 instead of the plurality of switches 121. Each of the plurality of semiconductor switches 123 is a switch for driving the motor. Hereinafter, a difference between the third duct control apparatus 1C and the first duct control apparatus 1A will be mainly described.

For example, the third duct control apparatus 1C is used when the number of times the opening and closing of the duct opening and closing device is performed is relatively large or when the degree of opening of the duct opening and closing device needs to be adjusted with relatively high accuracy. Therefore, the motor board 12 includes the plurality of semiconductor switches 123 that can be opened and closed in a relatively short time.

Figure 5:
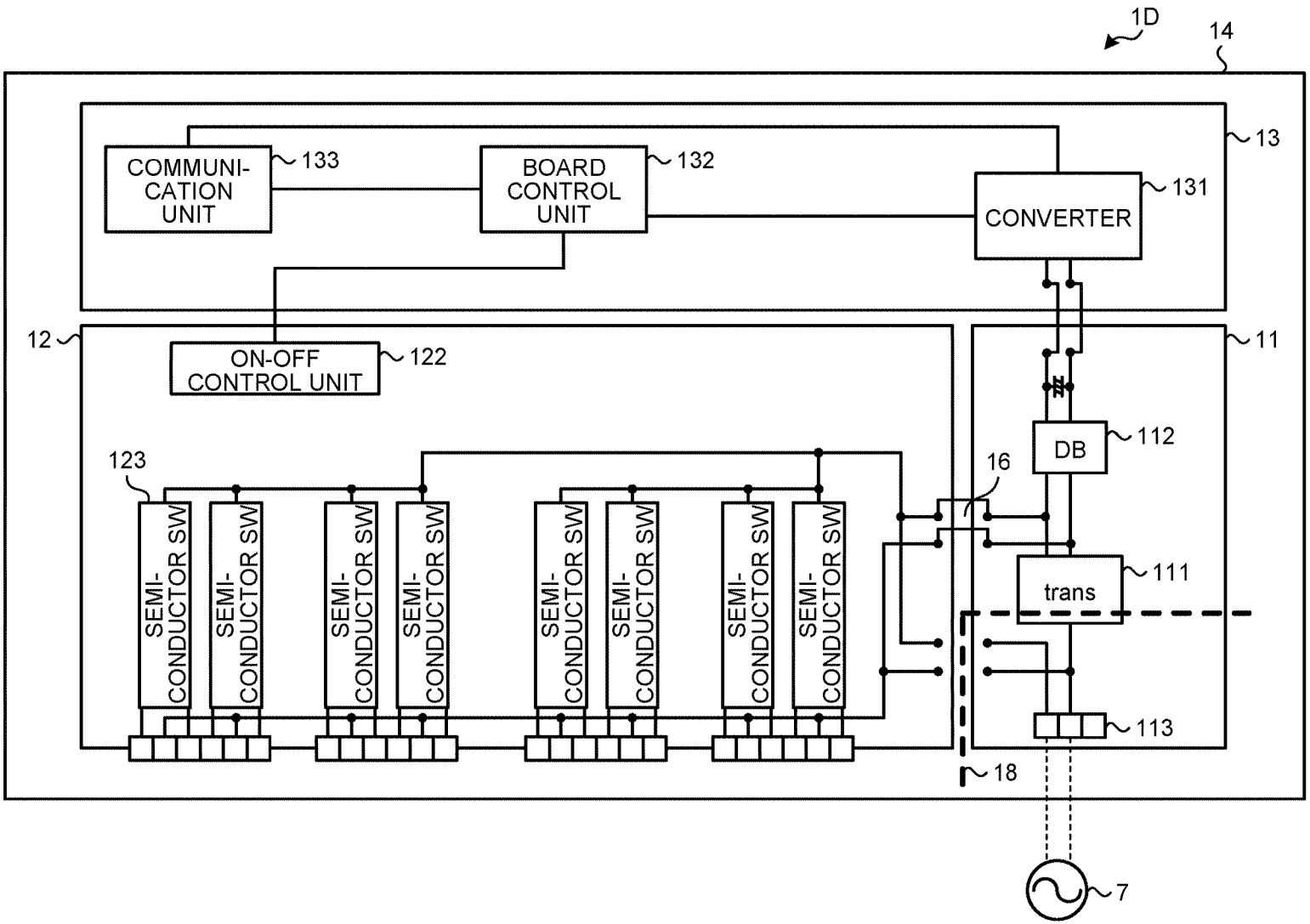
FIG. 5 is a diagram illustrating a configuration of a fourth duct control apparatus according to the embodiment.

FIG. 5 is a diagram illustrating a configuration of a fourth duct control apparatus 1D according to the embodiment. The fourth duct control apparatus 1D is another example of the duct control apparatus 1. The fourth duct control apparatus 1D is an apparatus that controls the duct opening and closing device based on a relatively low voltage. The fourth duct control apparatus 1D includes a plurality of constituent elements of the second duct control apparatus 1B except the plurality of switches 121. As with the third duct control apparatus 1C, the fourth duct control apparatus 1D includes the plurality of semiconductor switches 123 instead of the plurality of switches 121. Hereinafter, a difference between the fourth duct control apparatus 1D and the second duct control apparatus 1B will be mainly described.

For example, the fourth duct control apparatus 1D is used when the number of times the opening and closing of the duct opening and closing device is performed is relatively large or when the degree of opening of the duct opening and closing device needs to be adjusted with relatively high accuracy. Therefore, the motor board 12 includes the plurality of semiconductor switches 123 that can be opened and closed in a relatively short time.

Figure 6:
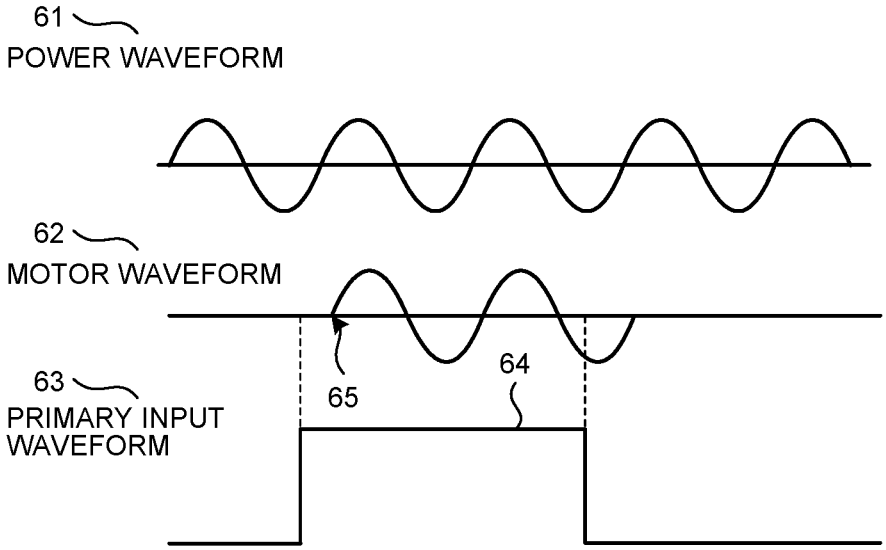
FIG. 6 is a diagram for describing a method in which the duct control apparatus according to the embodiment adjusts the degree of opening of the duct opening and closing device.

FIG. 6 is a diagram for describing a method in which the duct control apparatus 1 according to the embodiment adjusts the degree of opening of the duct opening and closing device. A method in which the third duct control apparatus 1C of FIG. 4 and the fourth duct control apparatus 1D of FIG. 5 each adjust the degree of opening of the duct opening and closing device will be described with reference to FIG. 6. A power waveform 61 is the waveform of the commercial power or power obtained the lowering of the commercial power to 24 V. A waveform to be output from the board control unit 132 of the control board 13 is a primary input waveform 63 to be input to the on-off control unit 122 of the motor board 12. A motor waveform 62 is the waveform of power to be supplied to the motor.

The on-off control unit 122 puts an AC waveform in an on-state 64 for a time period in which the duct opening and closing device is opened in accordance with the degree of opening of the duct opening and closing device. The frequency of the commercial power is, for example, 50 Hz or 60 Hz. Therefore, the number of pulses of the motor can be controlled if switching between on and off can be performed in the order of, for example, milliseconds. Reference numeral 65 denotes a zero-cross point of the motor waveform 62. It is possible to control the turn-on and turn-off of the semiconductor switching device for each number of pulses of the sine wave of commercial power by using a type of semiconductor switching device that performs switching between on and off by detecting the zero-cross point 65. As a result, the duct control apparatus 1 can adjust the degree of opening with higher accuracy.

Figure 7:
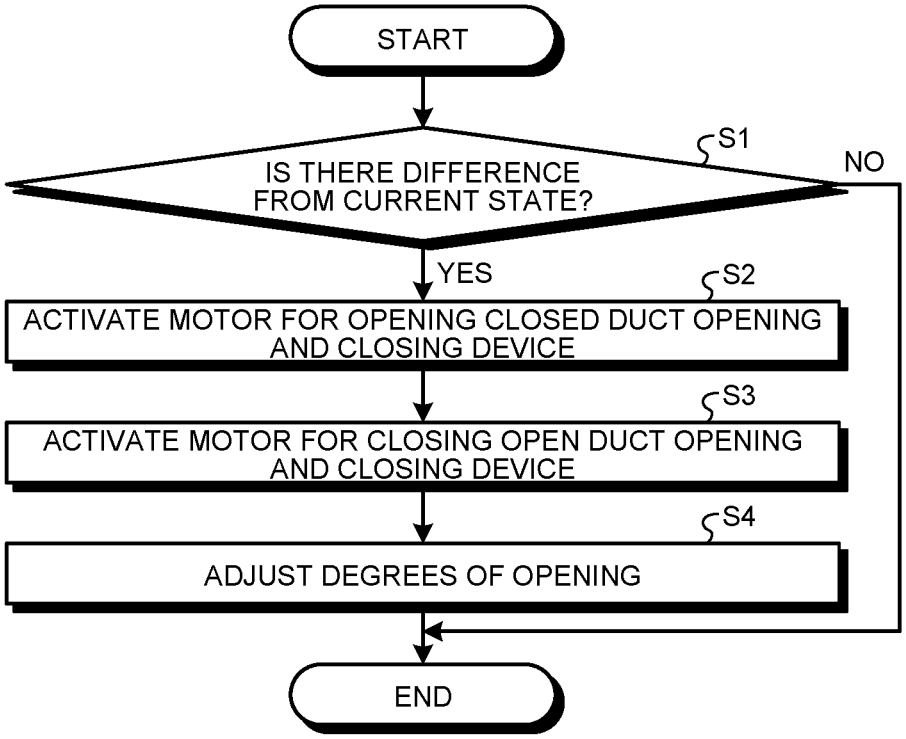
FIG. 7 is a flowchart illustrating an example of a procedure of operation to be performed by the duct control apparatus according to the embodiment when the duct control apparatus controls the duct opening and closing device.

FIG. 7 is a flowchart illustrating an example of a procedure of operation to be performed by the duct control apparatus 1 according to the embodiment when the duct control apparatus 1 controls the duct opening and closing device. For example, FIG. 7 illustrates a control method to be performed in a case where the current capacity of the transformer 111 of the power supply board 11 is relatively small. There are cases where a plurality of motors cannot be simultaneously driven. In such cases, when the duct opening and closing devices are opened and closed one by one in turn, there is a possibility that the user may feel stress by waiting during time required for operation of opening and closing all the duct opening and closing devices. Therefore, opening and closing control is effective to prevent such stress.

For example, when there are eight duct opening and closing devices and it takes one minute to perform the operation of opening and closing each single duct opening and closing device, it takes eight minutes to complete the operation of opening and closing all the duct opening and closing devices. The flow of FIG. 7 is effective in preventing the user from feeling stress for this time. First, the user performs a duct opening and closing operation by using the operation unit 6. The duct control apparatus 1 determines whether an open/close state specified in an instruction corresponding to the user's operation is different from a current open/close state (S1). That is, in step S1, the duct control apparatus 1 determines whether the state corresponding to the instruction is different from the current open/close state. When determining that the state corresponding to the instruction is not different from the current open/close state (No in S1), the duct control apparatus 1 ends the operation.

When determining that the state corresponding to the instruction is different from the current open/close state (Yes in S1), the duct control apparatus 1 activates a motor for opening a closed duct opening and closing device (S2). As a result, the user can feel wind. Therefore, while the volume of air may not be as requested by the user in some cases, the duct control apparatus 1 can reduce the dissatisfaction of the user. If an abutting direction in the control of the motor is set to a state in which the duct opening and closing device is closed, operation of opening the closed duct opening and closing device can be performed within a relatively short time. It is thus possible to achieve a relatively short motor operation time.

Thereafter, the duct control apparatus 1 activates a motor for closing an open duct opening and closing device (S3). Accordingly, changes in the open/close states of the duct opening and closing devices are completed. Thereafter, the duct control apparatus 1 adjusts the degrees of opening of the duct opening and closing devices as set by the user (S4).

As described above, when it is not possible to cause a plurality of duct opening and closing devices to simultaneously operate, the motor board 12 performs control for causing only a closed duct opening and closing device to operate among the plurality of duct opening and closing devices, for a motor corresponding to the closed duct opening and closing device among the plurality of motors. Thereafter, the motor board 12 performs control for causing an open duct opening and closing device to operate, for a motor corresponding to the open duct opening and closing device among the plurality of motors.

As described above, the motors are connected to the motor board 12, and the motor board 12 controls the motors. The motor controls the opening and closing of the corresponding duct opening and closing device, and adjusts the degree of opening. Therefore, the duct control apparatus 1 according to the embodiment can perform control for adjusting the degrees of opening of the duct opening and closing devices.

The motor board 12 may perform, for a plurality of motors, control for causing a plurality of duct opening and closing devices to operate in turn, the plurality of duct opening and closing devices opening and closing a plurality of ducts in accordance with the capacity of the commercial power or the capacity of power obtained by the lowering of the voltage of the commercial power.

The transformer 111 included in the power supply board 11 may be a transformer applicable to power with a capacity lower than a predetermined capacity. When it is not possible to cause the plurality of duct opening and closing devices to simultaneously operate, the plurality of duct opening and closing devices opening and closing a plurality of ducts, the motor board 12 performs control for closing an open duct opening and closing device among the plurality of duct opening and closing devices before performing adjustments such that degrees of opening of all the plurality of duct opening and closing devices coincide with respective specified degrees of opening, the control being performed for a motor corresponding to the open duct opening and closing device among the plurality of motors.

Figure 8:
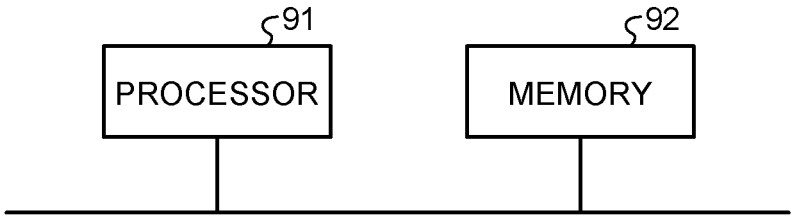
FIG. 8 is a diagram illustrating a processor that implements part of an on-off control unit or the entire on-off control unit included in a motor board of the first duct control apparatus according to the embodiment.

FIG. 8 is a diagram illustrating a processor 91 that implements part of the on-off control unit 122 or the entire on-off control unit 122 included in the motor board 12 of the first duct control apparatus 1A according to the embodiment. That is, some or all of the functions of the on-off control unit 122 may be implemented by the processor 91 that executes programs stored in a memory 92.

The processor 91 is a central processing unit (CPU), a processing device, an arithmetic device, a microprocessor, or a digital signal processor (DSP). FIG. 8 also illustrates the memory 92.

In a case where some or all of the functions of the on-off control unit 122 are implemented by the processor 91, the at least some of the functions of the on-off control unit 122 are implemented by the processor 91 and software, firmware, or a combination of software and firmware. The software or firmware is described as a program, and stored in the memory 92. The processor 91 implements some or all of the functions of the on-off control unit 122 by reading and executing the programs stored in the memory 92.

In a case where some or all of the functions of the on-off control unit 122 are implemented by the processor 91, the first duct control apparatus 1A includes the memory 92 for storing programs that cause the processor 91 to eventually execute some or all of steps to be executed by the on-off control unit 122. It can also be said that the programs stored in the memory 92 cause a computer to execute part of a procedure or method or the entire procedure or method to be executed by the on-off control unit 122.

Examples of the memory 92 include a nonvolatile or volatile semiconductor memories such as a random access memory (RAM), a read only memory (ROM), a flash memory, an erasable programmable read only memory (EPROM), and an electrically erasable programmable read-only memory (EEPROM) (registered trademark); a magnetic disk; a flexible disk; an optical disk; a compact disk; a mini disk; and a digital versatile disk (DVD).

Figure 9:
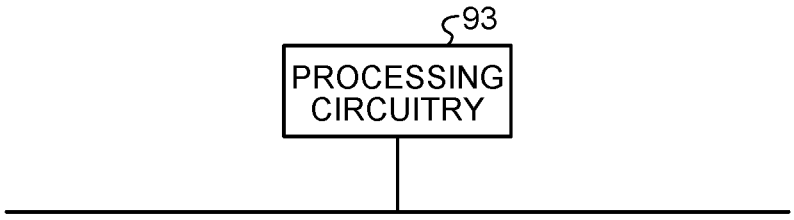
FIG. 9 is a diagram illustrating processing circuitry that implements part of the on-off control unit or the entire on-off control unit included in the motor board of the first duct control apparatus according to the embodiment.

FIG. 9 is a diagram illustrating processing circuitry 93 that implements part of the on-off control unit 122 or the entire on-off control unit 122 included in the motor board 12 of the first duct control apparatus 1A according to the embodiment. That is, part of the on-off control unit 122 or the entire on-off control unit 122 may be implemented by the processing circuitry 93.

The processing circuitry 93 is dedicated hardware. Examples of the processing circuitry 93 include a single circuit, a composite circuit, a programmed processor, a parallel-programmed processor, an application specific integrated circuit (ASIC), a field-programmable gate array (FPGA), and a combination thereof.

Part of the on-off control unit 122 may be dedicated hardware separate from the rest.

With regard to a plurality of the functions of the on-off control unit 122, some of the plurality of functions may be implemented by software or firmware, and the rest of the plurality of functions may be implemented by dedicated hardware. Thus, the plurality of functions of the on-off control unit 122 can be implemented by hardware, software, firmware, or a combination thereof.

Part of the on-off control unit 122 or the entire on-off control unit 122 included in each of the second duct control apparatus 1B, the third duct control apparatus 1C, and the fourth duct control apparatus 1D may be implemented by a processor or may be implemented by processing circuitry, as with the on-off control unit 122 included in the first duct control apparatus 1A.

At least part of the board control unit 132 and the communication unit 133 included in the control board 13 of each of the first duct control apparatus 1A, the second duct control apparatus 1B, the third duct control apparatus 1C, and the fourth duct control apparatus 1D may be implemented by a processor or may be implemented by processing circuitry.

The configurations set forth in the above embodiment show examples, and it is possible to combine the configurations with another technique that is publicly known, and is also possible to make omissions or changes to part of the configurations without departing from the gist of the present disclosure.

The invention claimed is:

1. A duct control apparatus for controlling a motor to control opening and closing of a duct opening and closing damper provided in a duct for sending air from an air conditioner to a room, the apparatus comprising:

a power supply board to receive commercial power;

a motor board to control the motor based on the commercial power received by the power supply board; and a control board to control the motor board based on the commercial power received by the power supply board, wherein the motor board performs, for the motor, control of the opening and closing of the duct opening and closing damper and control for adjusting a degree of opening of the duct opening and closing damper, the power supply board, the motor board, and the control board are provided in a single unit, the motor board has a function of controlling a plurality of motors, when a power capacity of the motor board is lower than a predetermined capacity for causing to cause respective motors that control a plurality of duct opening and closing devices dampers to simultaneously drive, the plurality of duct opening and closing devices dampers to open or close a plurality of ducts, the motor board for each duct opening and closing damper among the plurality of duct opening and closing dampers, determines whether the duct opening and closing damper is closed, and performs control for causing only the duct opening and closing damper determined to be closed to operate among the plurality of duct opening and closing dampers, the control being performed for a motor corresponding to the duct opening and closing damper determined to be closed among the plurality of motors.

2. A duct control apparatus for controlling a motor to control opening and closing of a duct opening and closing damper provided in a duct for sending air from an air conditioner to a room, the apparatus comprising:

a power supply board to receive commercial power;

a motor board to control the motor based on the commercial power received by the power supply board; and a control board to control the motor board based on the commercial power received by the power supply board, wherein the motor board performs, for the motor, control of the opening and closing of the duct opening and closing damper and control for adjusting a degree of opening of the duct opening and closing damper, the power supply board, the motor board, and the control board are provided in a single unit, the motor board has a function of controlling a plurality of motors, and when a power capacity of the motor board is lower than a predetermined capacity for causing respective motors that control a plurality of duct opening and closing dampers to simultaneously drive the plurality of duct opening and closing dampers to open or close a plurality of ducts, the motor board for each duct opening and closing damper among the plurality of duct opening and closing dampers, determines whether the duct opening and closing damper is open, and performs control for closing the open duct opening and closing damper determined to be open among the plurality of duct opening and closing devices and thereafter performs adjustments such that degrees of opening of all the plurality of duct opening and closing dampers coincide with respective specified degrees of opening, the control being performed for a motor corresponding to the open duct opening and closing damper determined to be open among the plurality of motors.

3. A duct control apparatus for controlling a motor to control opening and closing of a duct opening and closing damper provided in a duct for sending air from an air conditioner to a room, the apparatus comprising:

a power supply board to receive commercial power;

a motor board to control the motor based on the commercial power received by the power supply board; and a control board to control the motor board based on the commercial power received by the power supply board, wherein the motor board performs, for the motor, control of the opening and closing of the duct opening and closing damper and control for adjusting a degree of opening of the duct opening and closing damper, the power supply board, the motor board, and the control board are provided in a single unit, the motor board includes a switch to drive the motor, and an insulation distance between the switch and a portion of the power supply board, the commercial power being supplied to the portion when the motor board controls the motor based on a voltage lower than a voltage of the commercial power, is shorter than an insulation distance between the switch and a portion of the power supply board, the commercial power being supplied to the portion when the motor board controls the motor based on the voltage of the commercial power.

4. A duct control apparatus for controlling a motor to control opening and closing of a duct opening and closing damper provided in a duct for sending air from an air conditioner to a room, the apparatus comprising:

a power supply board to receive commercial power;

a motor board to control the motor based on the commercial power received by the power supply board; and a control board to control the motor board based on the commercial power received by the power supply board, wherein the motor board performs, for the motor, control of the opening and closing of the duct opening and closing damper and control for adjusting a degree of opening of the duct opening and closing damper, the power supply board, the motor board, and the control board are provided in a single unit, the power supply board has a function of lowering a voltage of the commercial power, and the motor board controls the motor based on one of the voltage of the commercial power and a voltage obtained by lowering of the voltage of the commercial power as a low-voltage power, the lowering of the voltage being performed by the power supply board, the apparatus further comprises:

a first connecting portion to connect the power supply board and the motor board and to supply the commercial power from the power supply board to the motor board, and a second connecting portion to connect the power supply board and the motor board and to supply the low-voltage power from the power supply board to the motor board, the low-voltage power being obtained by the lowering of the voltage of the commercial power, the lowering of the voltage being performed by the power supply board, wherein the motor board controls the motor based on one of the commercial power and the low-voltage power, the commercial power being supplied from the power supply board via the first connecting portion, the low-voltage power being supplied from the power supply board via the second connecting portion.

5. The duct control apparatus according to claim 4, wherein the power supply board includes a transformer, an area of the transformer being smaller than an area of the power supply board, the transformer is disposed on the power supply board, and lowers the voltage of the commercial power, the transformer is a basic-insulation transformer or a reinforced-insulation transformer, the basic-insulation transformer being a transformer having a relatively low insulation degree, the reinforced-insulation transformer being a transformer having a relatively high insulation degree, in a case where the transformer is the basic-insulation transformer, the transformer is a transformer that can be replaced with the reinforced-insulation transformer, and in a case where the transformer is the reinforced-insulation transformer, the transformer is a transformer that can be replaced with the basic-insulation transformer.

6. The duct control apparatus according to claim 5, wherein the motor board performs, for a plurality of motors, control for causing a plurality of duct opening and closing dampers to operate in turn, the plurality of duct opening and closing dampers opening and closing a plurality of ducts in accordance with a capacity of the commercial power or a capacity of power obtained by the lowering of the voltage of the commercial power.

* * * * *